US009023564B2

(12) United States Patent
Okada et al.

(10) Patent No.: US 9,023,564 B2
(45) Date of Patent: May 5, 2015

(54) AZOQUINONE COMPOUND, ELECTROPHOTOGRAPHIC PHOTOCONDUCTOR, AND IMAGE FORMING APPARATUS

(71) Applicant: KYOCERA Document Solutions Inc., Osaka-shi, Osaka (JP)

(72) Inventors: Hideki Okada, Osaka (JP); Keiji Maruo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/225,800

(22) Filed: Mar. 26, 2014

(65) Prior Publication Data

US 2014/0295335 A1 Oct. 2, 2014

(30) Foreign Application Priority Data

Mar. 27, 2013 (JP) ..... 2013-066084

(51) Int. Cl.
*G03G 5/06* (2006.01)

(52) U.S. Cl.
CPC ..... *G03G 5/0677* (2013.01); *G03G 5/0618* (2013.01)

(58) Field of Classification Search
CPC ..... G03G 5/0677; G03G 5/0618
USPC ..... 430/58.25, 58.4, 70, 58.35, 72; 534/886
See application file for complete search history.

(56) References Cited

U.S. PATENT DOCUMENTS

| | | | | |
|---|---|---|---|---|
| 5,558,965 | A * | 9/1996 | Nguyen et al. | 430/58.15 |
| 5,863,688 | A | 1/1999 | Watanabe et al. | |
| 5,994,012 | A | 11/1999 | Watanabe et al. | |
| 2002/0102484 | A1 * | 8/2002 | Miyamoto et al. | 430/58.25 |

FOREIGN PATENT DOCUMENTS

| | | |
|---|---|---|
| JP | 9-151157 | 6/1997 |

* cited by examiner

*Primary Examiner* — Janis L Dote
(74) *Attorney, Agent, or Firm* — Gerald E. Hespos; Michael J. Porco; Matthew T. Hespos

(57) ABSTRACT

The present disclosure relates to an azoquinone compound represented by formula (1) below.

[Chem. 1]

(1)

In formula (1), $R_1$ to $R_4$ are identical or different and each represents a hydrogen atom, a C1 to C6 alkyl group or a C6 to C12 aryl group, and Ar represents a C6 to C12 aryl group.

4 Claims, 5 Drawing Sheets

AZOQUINONE COMPOUND, ELECTROPHOTOGRAPHIC PHOTOCONDUCTOR, AND IMAGE FORMING APPARATUS

CROSS REFERENCE

The present application is based on Japanese Patent Application No. 2013-066084, filed with the JPO on Mar. 27, 2013, the contents whereof are incorporated herein by reference.

BACKGROUND

The present disclosure relates to an azoquinone compound, to an electrophotographic photoconductor that contains the azoquinone compound in a photoconductive layer, and to an image forming apparatus that is provided with the electrophotographic photoconductor.

Recent years have witnessed the development of organic compounds having various functions, such as charge transport properties and photoconductivity, and studies are being conducted on the use of such compounds in various fields, for instance electronic materials. The object of such studies is, for instance, the use of organic compounds having charge transport properties, among such organic compounds, in the field of organic photoconductors, organic EL elements, dye-sensitized solar cells and the like.

Among the foregoing, for instance, organic photoconductors are photoconductors for electrophotography that are provided in electrophotographic-type image forming apparatuses. Examples of electrophotographic photoconductors that are provided in such electrophotographic-type image forming apparatuses include, besides organic photoconductors, also inorganic photoconductors that is provided with a photoconductive layer made up of an inorganic material such as selenium, amorphous silicon or the like. Organic photoconductors are provided with a photoconductive layer that contains, as a main component of a photoconductor material, an organic material such as a charge generating agent, a charge transport agent or the like, in a binding resin. Organic photoconductors are known to afford, as a result, a wider range of choice as regards the photoconductor material that makes up the photoconductive layer, and a greater degree of freedom in terms of structural design, as compared with inorganic photoconductors.

Electrophotographic photoconductors are further required to exhibit for instance excellent photosensitivity, in order to form high-quality images. To obtain such electrophotographic photoconductors having excellent photosensitivity, the charge transport agent contained in the photoconductive layer must satisfy various conditions.

Both multilayer-type organic photoconductors and single layer-type organic photoconductors are being developed. Ordinarily, the charge transport agent used in these organic photoconductors is a hole transport agent in multilayer-types, and a hole transport agent and an electron transport agent in single layer-types. Conditions that apply to the foregoing photoconductors stipulate, for instance, that the charge transport agent should have high charge transport ability, appropriate ionization potential in order to take up efficiently the charge generated by the charge generating agent, high solubility in an organic solvent, such as tetrahydrofuran or the like, being the solvent of a coating solution that is used to form the photoconductive layer, and compatibility with the binding resin contained in the photoconductive layer.

Specific conventional examples of the electron transport agent that is included in the photoconductive layer of such an electrophotographic photoconductor include, for instance, naphthoquinone derivatives of predetermined structure, specifically, the naphthoquinone derivative represented by formula (7) below.

The above naphthoquinone derivative is known to have excellent electron transport ability and comparatively good solubility in solvents and compatibility with binding resins. Electrophotographic photoconductors in which this naphthoquinone derivative is used as an electron transport agent are known to have comparatively high sensitivity.

Meanwhile, image forming apparatuses provided with an electrophotographic photoconductor are required to afford yet higher image quality in the images that are formed therewith. For the reasons above, the material that is included in the photoconductive layer of the organic photoconductor that is used as an electrophotographic photoconductor provided in the image forming apparatus has to be a material such that, by being incorporated into the photoconductive layer, an electrophotographic photoconductor is obtained that allows forming images of yet higher quality. Specifically, the electrophotographic photoconductor is required to have yet better photosensitivity. That is, the material included in the photoconductive layer of the organic photoconductor has to be a material such that, by being incorporated into the photoconductive layer, a photoconductive layer is obtained that has yet better photosensitivity. In a case where the material is incorporated, as an electron transport agent, into the photoconductive layer of the electrophotographic photoconductor, a material is required that yields a photoconductive layer of better photosensitivity than in the case where the above naphthoquinone derivative is incorporated into the photoconductive layer.

In the light of the above, it is an object of the present invention to provide an azoquinone compound which, when incorporated into the photoconductive layer of an electrophotographic photoconductor, affords an electrophotographic photoconductor of excellent photosensitivity. A further object of the present invention is to provide an electrophotographic photoconductor that contains the azoquinone compound in a photoconductive layer, and to provide an image forming apparatus that is provided with the electrophotographic photoconductor.

SUMMARY

An azoquinone compound according to one aspect of the present disclosure is a compound represented by formula (1) below.

[Chem. 1]

(1)

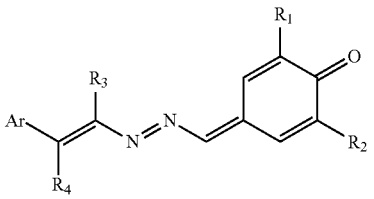

In formula (1), $R_1$ to $R_4$ are identical or different and each represents a hydrogen atom, a C1 to C6 alkyl group or a C6 to C12 aryl group, and Ar represents a C6 to C12 aryl group.

DETAILED DESCRIPTION

Figure 1A:
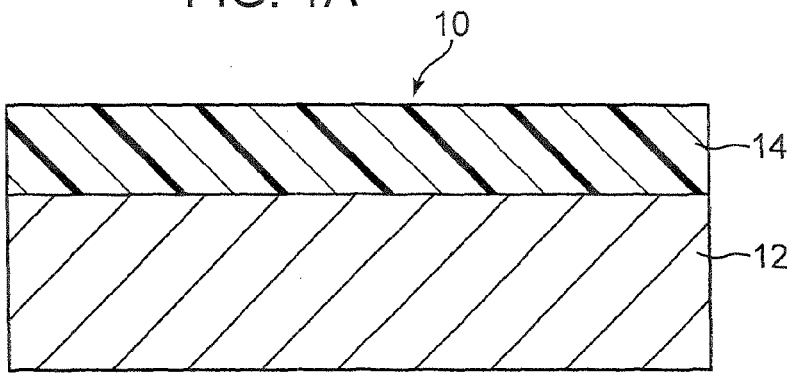
FIG. 1A to FIG. 1C are schematic cross-sectional diagrams illustrating the structure of a single layer-type photoconductor being an example of the electrophotographic photoconductor according to an embodiment of the present disclosure.

Embodiments according to the present disclosure are explained next, but the present disclosure is not limited to these embodiments.

[Azoquinone Compound]

An azoquinone compound according to an embodiment of the present disclosure is a compound represented by formula (1) below.

[Chem. 2]

(1)

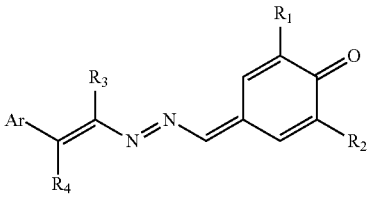

In formula (1), R1 to R4 and Ar are as follows.

Each of R1 to R4 may be identical or different. That is, R1 to R4 are independent from each other.

Further, R1 to R4 represent a hydrogen atom, a C1 to C6 alkyl group or a C6 to C12 aryl group. Among the foregoing, R1 and R2 are preferably a C1 to C6 alkyl group, and more preferably a t-butyl group and a methyl group. Further, $R_3$ is preferably a hydrogen atom or a C1 to C6 alkyl group, and more preferably a hydrogen atom or a methyl group. Further, $R_4$ is preferably a hydrogen atom, a C1 to C6 alkyl group or a C6 to C12 aryl group, more preferably a hydrogen atom, a methyl group or a phenyl group.

The C1 to C6 alkyl group is not particularly limited, so long as it is a C1 to C6 alkyl group, and may be linear or branched. Specific examples thereof include, for instance, methyl groups, ethyl groups, n-propyl groups, isopropyl groups, n-butyl groups, isobutyl groups, s-butyl groups, t-butyl groups, pentyl groups, isopentyl groups, neopentyl groups and hexyl groups.

The C6 to C12 aryl group is not particularly limited, so long as it is a C6 to C12 aryl group. Specific examples thereof include, for instance, phenyl groups, naphthyl groups and biphenylyl groups.

Further, Ar represents a C6 to C12 aryl group.

The C6 to C12 aryl group herein is not particularly limited, so long as it is a C6 to C12 aryl group. Specific examples thereof include, for instance, phenyl groups, naphthyl groups and biphenylyl groups. Among the foregoing Ar is preferably a phenyl group.

When incorporated into the photoconductive layer of an electrophotographic photoconductor, such an azoquinone compound yields an electrophotographic photoconductor having excellent photosensitivity. Such an azoquinone compound has excellent electron transporting ability, and hence can be used not only in electrophotographic photoconductors, but also, for instance, in organic EL elements and dye-sensitized solar cells. Specifically, for instance, an organic EL element of excellent emission efficiency can be obtained by incorporating the compound into an organic layer, such as an electron transport layer, of the organic EL element. Further, a dye-sensitized solar cell having excellent power generation efficiency can be obtained by incorporating the compound into, for instance, an electron transport layer of a dye-sensitized solar cell.

(Synthesis Method)

The method for synthesizing the azoquinone compound is not particularly limited, so long as the method allows synthesizing the azoquinone compound represented by formula (1) above. Specifically, for instance, the compound may be synthesized as indicated by formula (2) and formula (3) below.

[Chem. 3]

(2)

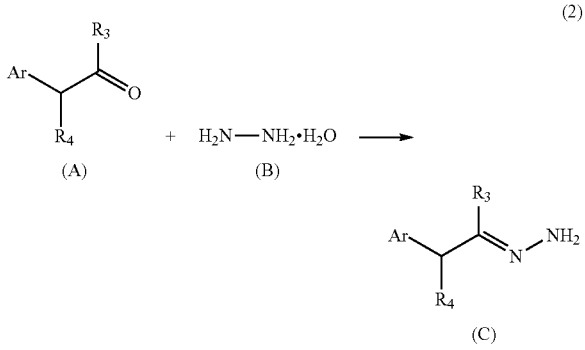

[Chem. 4]

(3)

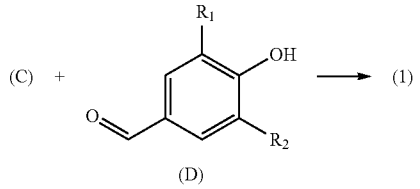

In formula (2) and formula (3) above, $R_1$ to $R_4$ and Ar have the same meaning as in formula (1) above. Specifically, R1 to $R_4$ are identical or different and each represents a hydrogen atom, a C1 to C6 alkyl group or a C6 to C12 aryl group. Further, Ar represents a C6 to C12 aryl group.

More specifically, the method for synthesizing the azoquinone compound is carried out as follows.

Firstly, a solution resulting from dissolving the compound represented by formula (A) above and the compound represented by formula (B) above (hydrazine monohydrate), in an organic solvent such as methanol, is stirred at room temperature. The reaction of formula (2) above progresses as a result, and there is synthesized the compound represented by formula (C) above. Thereafter, water is added to the obtained reaction solution, followed by extraction with chloroform, and the solvent of the obtained chloroform layer is distilled-off, to yield as a result the compound represented by formula (C) above.

Next, the solution resulting from dissolving the compound represented by formula (C) above in an organic solvent such as methanol, and the compound represented by formula (D) above, are stirred under heating. Water is added to the reaction solution obtained through stirring, and the resulting reaction solution is extracted with chloroform. The product obtained by distilling off the solvent from the obtained chloroform layer is dissolved in an organic solvent such as chloroform. Silver oxide is added then to the resulting solution, with stirring at room temperature. The reaction of formula (3) above progresses as a result of this operation, and there is synthesized the compound represented by formula (1) above. Thereafter, the obtained reaction solution is filtered, and the organic solvent in the obtained filtrate is distilled-off. The product is purified by column chromatography or the like. As a result there is obtained the above azoquinone compound, i.e. the compound represented by formula (1) above.

The azoquinone compound thus obtained can be used, as described above, as a material that is incorporated into the photoconductive layer of an electrophotographic photoconductor, or into an organic layer, such as an electron transport layer, of an organic EL element, or into an electron transport layer of a dye-sensitized solar cell. An instance of an electrophotographic photoconductor, from among the foregoing, will be explained next.

[Electrophotographic Photoconductor]

An electrophotographic photoconductor according to another embodiment of the present disclosure (hereafter also referred to simply as "photoconductor") is an electrophotographic photoconductor provided with a conductive base and a photoconductive layer, wherein the photoconductive layer contains the above azoquinone compound.

Such an electrophotographic photoconductor has excellent photosensitivity. Accordingly, high-quality images can be formed in a case where such an electrophotographic photoconductor is used as an image carrier in an image forming apparatus.

The photoconductor is not particularly limited, so long as the photoconductor satisfies the above characterizing feature, i.e. is an electrophotographic photoconductor such that a photoconductive layer thereof contains the azoquinone compound represented by formula (1) above. Specifically, the photoconductor may be for instance a so-called single layer-type photoconductor, i.e. a photoconductor such as the one illustrated in FIG. 1A to FIG. 1C, wherein the photoconductive layer thereof is a layer that contains, in one same layer, a charge generating agent, a charge transport agent such a hole transport agent or an electron transport agent, and a binding resin. As explained in detail further on, the binding resin that is used in the photoconductive layer (single layer-type photoconductive layer) of a single layer-type photoconductor will be referred to as binder resin.

The photoconductor may also be a so-called multilayer-type photoconductor, i.e. a photoconductor, such as the one illustrated in FIG. 2A to FIG. 2F, where the photoconductive layer is a stack of at least two layers of a charge generation layer that contains a charge generating agent and a binding resin, and a charge transport layer that contains a charge transport agent, such as a hole transport agent, and a binding resin. As explained in detail further on, in the case where a binding resin is used in the charge generation layer, the binding resin will be referred to as base resin, and the binding resin used in the charge transport layer will be referred to as binder resin, as in the case of the binding resin that is used in the above-described single layer-type photoconductive layer.

Figure 1B:
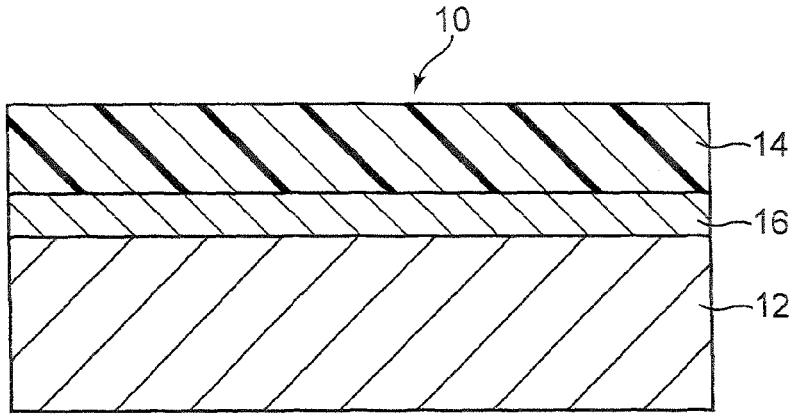
Figure 1C:
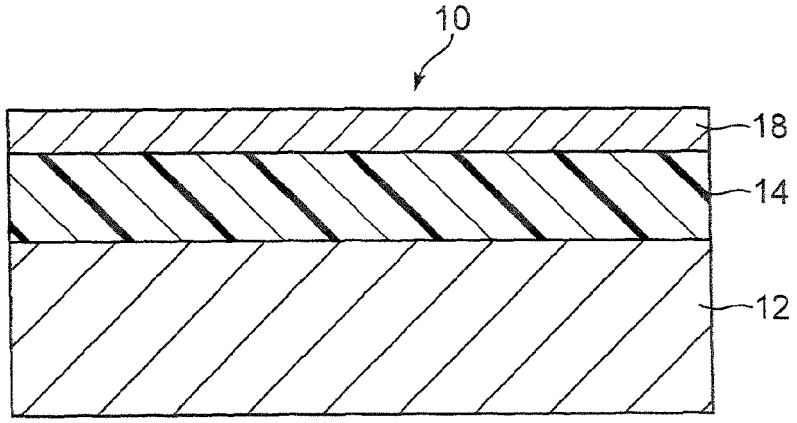

FIG. 1A to FIG. 1C are schematic cross-sectional diagrams illustrating the structure of a single layer-type photoconductor being an example of the electrophotographic photoconductor according to an embodiment of the present disclosure. FIG. 2A to FIG. 2F are schematic cross-sectional diagrams illustrating the structure of a multilayer-type photoconductor being another example of the electrophotographic photoconductor according to an embodiment of the present disclosure.

As illustrated in FIG. 1A to FIG. 1C, a single layer-type photoconductor 10 includes a conductive base 12, and provided on the conductive base 12, a photoconductive layer 14 in the form of a layer that contains, in one same layer, a charge generating agent, a charge transport agent such as a hole transport agent or an electron transport agent, and a binder resin, being a binding resin that is used in single layer-type photoconductors. The single layer-type photoconductor 10 is not particularly limited, so long as it is provided with the conductive base 12 and the photoconductive layer 14. Specifically, for instance, the photoconductive layer 14 may be provided in direct contact with the conductive base 12, as illustrated in FIG. 1A; also, an interlayer 16 may be provided between the conductive base 12 and the photoconductive layer 14, as illustrated in FIG. 1B. Further, the photoconductive layer 14 may be exposed by being an outermost layer, as illustrated in FIG. 1A and FIG. 1B; also, a protective layer 18 may be provided on the photoconductive layer 14, as illustrated in FIG. 1C.

Figure 2D:
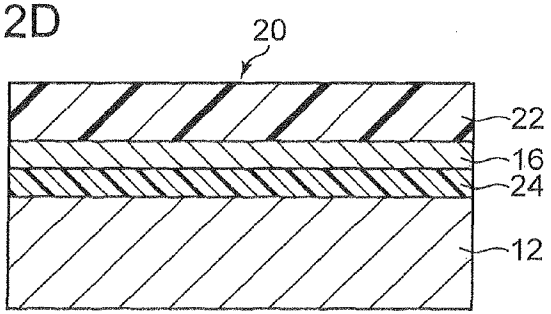
FIG. 2A to FIG. 2F are schematic cross-sectional diagrams illustrating the structure of a multilayer-type photoconductor being another example of the electrophotographic photoconductor according to an embodiment of the present disclosure.
Figure 2E:
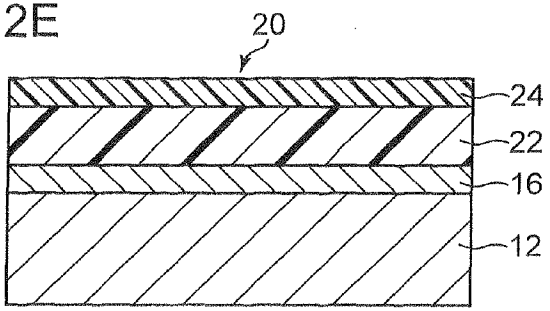
Figure 2F:
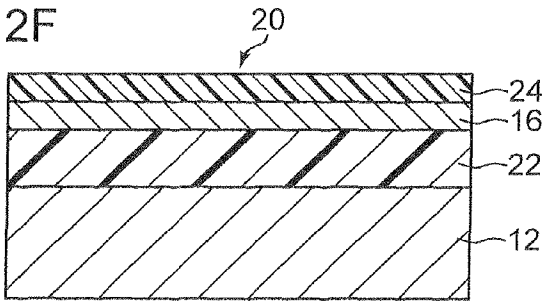
Figure 2A:
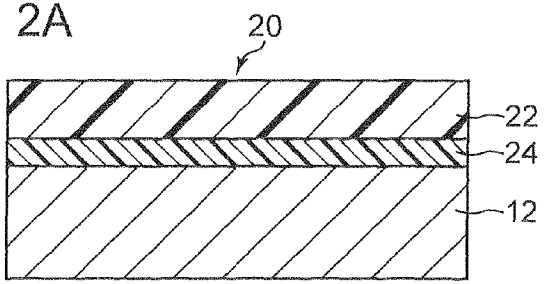
Figure 2B:
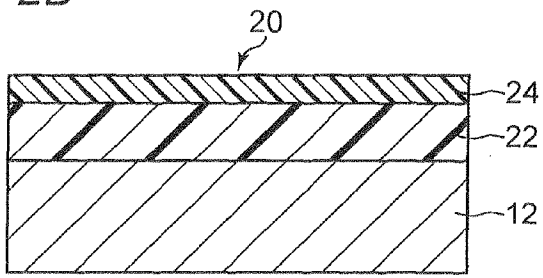
Figure 2C:
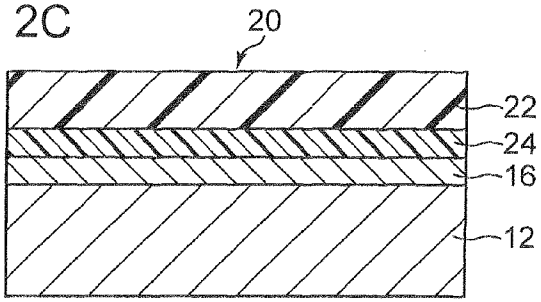

Next, as illustrated in FIG. 2A to FIG. 2F, the multilayer-type photoconductor 20 is a photoconductor that is provided with a conductive base 12, and thereon, a photoconductive layer in the form of a stack of at least two layers of a charge generation layer 24 that contains a charge generating agent and a base resin, and a charge transport layer 22 that contains a charge transport agent and a binder resin. The multilayer-type photoconductor 20 is not particularly limited, so long as it is provided with the conductive base 12, and with the photoconductive layer which is a stack of the charge generation layer 24 and the charge transport layer 22. Specifically, the multilayer-type photoconductor 20 may have the conductive base 12, and thereon, the charge generation layer 24 and the charge transport layer 22 stacked in this order, as illustrated in FIG. 2A, or may have the conductive base 12, and thereon, the charge transport layer 22 and the charge generation layer 24 stacked in this order, as illustrated in FIG. 2B. The photoconductive layer may be provided in direct contact with the conductive base 12, as illustrated in FIG. 2A and FIG. 2B; also, the interlayer 16 may be provided between the conductive base 12 and the photoconductive layer 14, as illustrated FIG. 2C and FIG. 2E. The interlayer 16 may be provided between the charge transport layer 22 and the charge generation layer 24, as illustrated in FIG. 2D and FIG. 2F. Further, the photoconductive layer may be exposed by being an outermost layer; also, a protective layer may be provided on the photoconductive layer.

A photoconductor having excellent photosensitivity can be obtained if the photoconductor satisfies the above configuration, i.e. if the photoconductive layer in the photoconductor contains the azoquinone compound. Examples of the structure of the photoconductor include, for instance, a single layer-type photoconductor and a multilayer-type photoconductor such as those described above. A single layer-type photoconductor is preferred among the foregoing. That is, the photoconductive layer is preferably a layer that contains, in one same layer, at least a charge generating agent, a hole transport agent, an electron transport agent and a binding resin, and the electron transport agent contains the azoquinone compound.

The above configuration results not only in excellent photosensitivity, but also allows producing the photoconductive layer configuration in an easy manner, while suppressing the occurrence of coating defects in the photoconductive layer. This involves, specifically, the following.

Firstly, it is deemed that the photoconductive layer configuration is easy to produce if such a single layer-type photoconductor has at least a charge generating agent, a hole transport agent, an electron transport agent and a binding resin formed into one same layer, as the photoconductive layer. More specifically, a single layer-type photoconductor can be produced more easily since, by contrast, at least two layers must be formed to produce a so-called multilayer-type photoconductor, i.e. a photoconductor where the photoconductive layer is a stack of at least two layers of a charge generation layer that contains a charge generating agent and a binding resin, and a charge transport layer that contains a charge transport agent and a binding resin.

The charge generation layer and the charge transport layer in multilayer-type photoconductors are often thinner than the photoconductive layer in a single layer-type photoconductors. Further, multilayer-type photoconductors are known to exhibit greater changes in electrical characteristics than single layer-type photoconductors, in cases where the charge transport layer that constitutes an outer layer is worn out through repeated use of the photoconductor.

The layers that make up the electrophotographic photoconductor are explained next.

[Conductive Base]

The conductive base is not particularly limited so long as it can be used as the conductive base of the electrophotographic photoconductor. Specific examples thereof include, for instance, a conductive base wherein at least the surface section thereof is made up of a material having conductivity. Specifically, for instance, the conductive base may include a material having conductivity, or may be a conductive base wherein the surface of a plastic material or the like is covered with a material having conductivity. Examples of the material having conductivity include, for instance, aluminum, iron, copper, tin, platinum, silver, vanadium, molybdenum, chromium, cadmium, titanium, nickel, palladium, indium, stainless steel, brass and the like. As the material having conductivity there may be used one single type of material having conductivity, or a combination of two or more types, for instance an alloy or the like. Preferably, the conductive base is made up of, among the foregoing, aluminum or an aluminum alloy. As a result it becomes possible to provide a photoconductor that is capable of forming more suitable images. This can be ascribed to the good mobility of charge from the photoconductive layer to the conductive base.

The shape of the conductive base is not particularly limited. Specifically, the conductive base may be sheet-like or drum-like. That is, the shape of the conductive base is not particularly limited, and may be a sheet-like shape or a drum-like shape, in accordance with the structure of the image forming apparatus that is used.

[Photoconductive Layer]

The single layer-type photoconductor has one photoconductive layer that includes at least a charge generating agent, and a charge transport agent such as a hole transport agent and an electron transport agent, in a binder resin. Further, the photoconductive layer of the multilayer-type photoconductor includes a charge generation layer including at least a charge generating agent, and a charge transport layer including at least a charge transport agent in a binder resin.

The azoquinone compound represented by formula (1) above functions mainly as an electron transport agent, being one charge transport agent contained in the photoconductive layer of the single layer-type photoconductor, or in the charge transport layer of the multilayer-type photoconductor. The layer structure of the photoconductive layer is not particularly limited, and, for instance, may involve specifically the photoconductive layer structures illustrated in FIG. 1A to FIG. 1C and FIG. 2A to FIG. 2F, as described above.

(Charge Generating Agent)

The charge generating agent that is used is not particularly limited, so long as it is used as a charge generating agent of electrophotographic photoconductors. Specific examples of the charge generating agent include, for instance, powders of inorganic photoconductive materials, such as X-form metal-free phthalocyanine (x-$H_2$Pc), Y-form oxotitanylphthalocyanine (Y-TiOPc), perylene pigments, bis-azo pigments, dithioketo-pyrrolo-pyrrole pigments, metal-free naphthalocyanine pigments, metal naphthalocyanine pigments, squaraine pigments, trisazo pigments, indigo pigments, azulenium pigments, cyanine pigments, selenium, selenium-tellurium, selenium-arsenic, cadmium sulfide, amorphous silicon and the like; and pyrylium salts, anthanthrone pigments, triphenylmethane pigments, threne pigments, toluidine pigments, pyrazoline pigments, quinacridone pigments and the like.

The charge generating agent may be used singly or in combinations of two or more types, in such a way so as to have an absorption wavelength at desired regions. Photoconductors having sensitivity at a wavelength region of 700 nm or longer are required, in particular, in a digital optical-type image forming apparatus, such as a laser beam printer or a fax machine, that utilizes a light source such as a semiconductor laser or the like; accordingly, for instance, phthalocyanine-based pigments that include metal-free phthalocyanines such as X-form metal-free phthalocyanine (x-H2Pc), or oxotitanylphthalocyanines such as Y-form oxotitanylphthalocyanine (Y-TiOPc) are preferably used among the above charge generating agents. The crystalline form of the phthalocyanine pigment is not particularly limited, and various crystalline forms may be resorted to.

An anthanthrone pigment or a perylene pigment is used as the charge generating agent in the case of an image forming apparatus that utilizes a short-wavelength laser light source, from 350 to 550 nm.

(Charge Transport Agent)

The charge transport agent is not particularly limited so long as it can be used as a charge transport agent included in the photoconductive layer of electrophotographic photoconductors. Examples of the charge transport agent include ordinarily hole transport agents that transport holes having positive charge, and electron transport agents that transport electrons having negative charge.

The hole transport agent is not particularly limited so long as it can be used as a hole transport agent included in the photoconductive layer of electrophotographic photoconductors. Specific examples thereof include, for instance, benzidine derivatives; oxadiazole-based compounds such as 2,5-di (4-methyl aminophenyl)-1,3,4-oxadiazole; styryl-based compounds such as 9-(4-diethylaminostyryl)anthracene; carbazole-based compounds such as polyvinyl carbazole; organopolysilane compounds; pyrazoline compounds such as, 1-phenyl-3-(p-dimethylaminophenyl)pyrazoline; nitrogen-containing cyclic compounds such as hydrazone compounds, triphenylamine compounds, indole compounds, oxazole compounds, isoxazole compounds, thiazole compounds, thiadiazole compounds, imidazole compounds, pyrazole compounds and triazole compounds; and condensed polycyclic compounds. Preferred among the foregoing are triphenylamine compounds and benzidine derivatives, and more preferably benzidine derivatives. The hole transport agent that is used may be a single type of the hole transport agents exemplified above, or combinations of two or more types thereof.

The electron transport agent is not particularly limited so long as it can be used as an electron transport agent included in the photoconductive layer of electrophotographic photoconductors. The photoconductor according to the present embodiment contains the azoquinone compound represented by formula (1) above in the photoconductive layer. The azoquinone compound may function as an electron transport agent. Specifically, example of the photoconductor according to the present embodiment contains the azoquinone compound represented by formula (1) above as the electron transport agent. The photoconductor may be a photoconductor that contains only the azoquinone compound represented by formula (1) above, as the electron transport agent.

Other electron transport agents besides the azoquinone compound may also be incorporated as the electron transport agent. Specific examples of other electron transport agents include, for instance, quinone derivatives, naphthoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, dibromomaleic anhydride and the like. The electron transport agent that is used may be a single type of the electron transport agents exemplified above, or combinations of two or more types thereof.

(Binding Resin)

Examples of the binding resin include for instance, as described above, a binder resin being the binding resin that is used in the photoconductive layer of a single layer-type photoconductor or in the charge transport layer of a multilayer-type photoconductor, or may be a base resin that is a binding resin used in the charge generation layer of a multilayer-type photoconductor.

The binder resin is not particularly limited, so long as it can be used as the binding resin that is included in the photoconductive layer of a single layer-type photoconductor and in the charge transport layer of a multilayer-type photoconductor. Specific examples thereof include, for instance, thermoplastic resins such as styrene resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polycarbonate resins, polyarylate resins, polysulfone resins, diallyl phthalate resins, ketone resins, polyvinyl butyral resins, polyether resins, polyester resins and the like; and thermosetting resins such as silicone resins, epoxy resins, phenolic resins, urea resins, melamine resins and other crosslinked resins. Further examples include, for instance, photocurable resins such as epoxyacrylate resins, urethane-acrylate copolymer resins and the like. Polycarbonate resins are preferred among the foregoing. The binder resin that is used may be a single type of the binder resins exemplified above, or combinations of two or more types thereof.

The base resin is not particularly limited, so long as it can be used as a binding resin that is included in the charge generation layer of a multilayer-type photoconductor. Specific examples thereof include, for instance, styrene-butadiene copolymers, styrene-acrylonitrile copolymers, styrene-maleic acid copolymers, acrylic copolymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, polyurethane resins, polysulfone resins, diallyl phthalate resins, ketone resins, polyvinyl acetal resins, polyvinyl butyral resins, polyether resins, silicone resins, epoxy resins, phenolic resins, urea resins, melamine resins, epoxy acrylate resins, urethane-acrylate resins and the like. The base resin that is used may be a single type of the base resins exemplified above, or combinations of two or more types thereof.

Resins identical to the above binder resins are exemplified as the base resin, but in one same photoconductor a resin that is different from the binder resin is ordinarily selected. The reasons for this are as follows. The charge generation layer and the charge transport layer are ordinarily formed in this order in the production of the multilayer-type photoconductor. Therefore, a coating solution for forming the charge transport layer is coated onto the charge generation layer, and, accordingly, the charge generation layer must not be dissolved by the solvent of the coating solution for forming the charge transport layer. In one same photoconductor, therefore, the base resin that is the binding resin included in the charge generation layer is ordinarily selected to be a resin different from the binder resin.

(Additives)

Besides the charge generating agent and the charge transport agent, the binding resin in the photoconductor may contain various additives, in amounts that do not adversely affect the electrophotographic characteristics of the photoconductor. Specific examples of such additives include, for instance, degradation inhibitors such as antioxidants, radical scavengers, singlet quenchers, ultraviolet absorbers or the like, as well as softeners, plasticizers, surface modifiers, bulking agents, thickeners, dispersion stabilizers, waxes, acceptors, donors, surfactants and leveling agents. Known sensitizers such as terphenyl, halonaphthoquinones, acenaphthylene or the like may be used concomitantly with the charge generating agent, in order to enhance the sensitivity of the photoconductive layer.

[Method for Producing an Electrophotographic Photoconductor]

A method for producing an electrophotographic photoconductor will be explained next.

A method for producing the single layer-type photoconductor will be explained first.

The single layer-type photoconductor can be produced, for instance, by coating the conductive base with a coating solution obtained by dissolving or dispersing, in a solvent, for instance the charge generating agent, the charge transport agent (hole transport agent, electron transport agent), the binder resin and, as needed, various additives, and drying then the coating solution. The coating method is not particularly limited, and may be, for instance, dip coating.

The respective contents of the charge generating agent, the charge transport agent and the binder resin in the single layer-type photoconductor are not particularly limited, and may be selected as appropriate. Specifically, for instance, the content of the charge generating agent is preferably 0.1 to 50 parts by mass, and more preferably 0.5 to 30 parts by mass, with respect to 100 parts by mass of the binder resin. The content of the electron transport agent is preferably 5 to 100 parts by mass, and more preferably 10 to 80 parts by mass, with respect to 100 parts by mass of the binder resin. The content of the hole transport agent is preferably 5 to 500 parts by mass, and more preferably 25 to 200 parts by mass, with respect to 100 parts by mass of the binder resin. The total amount of the hole transport agent plus electron transport agent, i.e. the content of the charge transport agent, is preferably 20 to 500 parts by mass, more preferably 30 to 200 parts by mass, with respect to 100 parts by mass of the binder resin.

The thickness of the photoconductive layer of the single layer-type photoconductor is not particularly limited, so long as the photoconductive layer can function sufficiently as a photoconductive layer. Specifically, for instance, the thickness ranges preferably from 5 to 100 μm, and more preferably from 10 to 50 μm.

A method for producing the multilayer-type photoconductor is explained next.

The multilayer-type photoconductor can be produced, for instance, in accordance with method such as the below-described one.

Specifically, for instance, a coating solution for forming a charge generation layer and that is obtained by dissolving or dispersing, in a solvent, the charge generating agent, a base resin and various additives, as needed, as well as a coating solution for forming a charge transport layer and that is obtained by dispersing or dissolving, in a solvent, the charge transport agent, a binder resin and various additives, as needed, are prepared first. Then, either one of the coating solution for forming a charge generation layer and the coating solution for forming a charge transport layer is applied, by coating or the like, onto the conductive base, followed by drying, to form thereby either the charge generation layer or the charge transport layer. Thereafter, the other coating solution is coated onto the conductive base, having had the charge generation layer or the charge transport layer formed thereon, and is dried, to form thereby the other layer. The multilayer-type photoconductor can be thus produced as a result. The coating method is not particularly limited, and may be, for instance, dip coating.

The respective contents of the charge generating agent, the charge transport agent, the base resin and the binder resin in the multilayer-type photoconductor are not particularly limited, and may be selected as appropriate. Specifically, for instance, the content of the charge generating agent is preferably 5 to 1000 parts by mass, more preferably 30 to 500 parts by mass, with respect to 100 parts by mass of the base resin that makes up the charge generation layer.

The content of the charge transport agent is preferably 10 to 500 parts by mass, more preferably 25 to 100 parts by mass, with respect to 100 parts by mass of the binder resin that makes up the charge transport layer.

The thicknesses of the charge generation layer and the charge transport layer are not particularly limited, so long as the respective layers can sufficiently function as such. Specifically, for instance, the thickness of the charge generation layer ranges preferably from 0.01 to 5 μm, more preferably from 0.1 to 3 μm. Specifically, for instance, the thickness of the charge transport layer ranges preferably from 2 to 100 μm, more preferably from 5 to 50 μm.

The solvent in the coating solutions is not particularly limited, so long as it can dissolve or disperse the various components above. Specific examples thereof include, for instance, alcohols such as methanol, ethanol, isopropanol, butanol and the like; aliphatic hydrocarbons such as n-hexane, octane, cyclohexane and the like; aromatic hydrocarbons such as benzene, toluene, xylene and the like; halogenated hydrocarbons such as dichloromethane, dichloroethane, carbon tetrachloride, chlorobenzene and the like; ethers such as dimethyl ether, diethyl ether, tetrahydrofuran, ethylene glycol dimethyl ether, diethylene glycol dimethyl ether and the like; ketones such as acetone, methyl ethyl ketone, cyclohexanone and the like; esters such as ethyl acetate, methyl acetate and the like; as well as dimethylformamide, dimethylformaldehyde and dimethyl sulfoxide. The solvent that is used may be a single type of the solvents exemplified above, or combinations of two or more types thereof.

The electrophotographic photoconductor can be used as an image carrier in an electrophotographic-type image forming apparatus. The image forming apparatus is not particularly limited, so long as it is of electrophotographic type. The electrophotographic photoconductor can be used specifically, for instance, as an image carrier in the below-described image forming apparatus.

[Image Forming Apparatus]

The image forming apparatus intended to be provided with the electrophotographic photoconductor is not particularly limited, so long as it is an image forming apparatus of electrophotographic type. Specifically, for instance, the image forming apparatus may be provided with: an image carrier; a charging device for charging the surface of the image carrier; an exposure device for exposing the surface of the charged image carrier and forming an electrostatic latent image on the surface of the image carrier; a developing device for developing the electrostatic latent image in the form of a toner image; and a transfer device for transferring the toner image from the image carrier onto a transfer-receiving member; wherein the image carrier is the electrophotographic photoconductor. Such an image forming apparatus where the image carrier is the electrophotographic photoconductor allows forming images of high quality. This is because an electrophotographic photoconductor of excellent photosensitivity is used as the image carrier in the image forming apparatus.

Tandem-type color image forming apparatuses that utilize toners of a plurality of colors are preferably used, as described further on. A more specific example thereof includes, for instance, a tandem-type color image forming apparatus such as the below-described one, which utilizes toners of a plurality of colors. A tandem-type color image forming apparatus will be explained herein.

The image forming apparatus provided with the electrophotographic photoconductor according to the present embodiment is provided with: a plurality of image carriers that are juxtaposed in a predetermined direction, in order to cause respective toner images to be formed, on the surfaces of the image carriers, by respective toners of mutually dissimilar colors; and a plurality of developing devices each provided with a developing roller that is disposed opposing a respective image carrier, such that the developing roller carries toner on, and transports toner over, the surface thereof, and supplies the transported toner to the surface of the respective image carrier; wherein the image carrier is the electrophotographic photoconductor.

Figure 3:
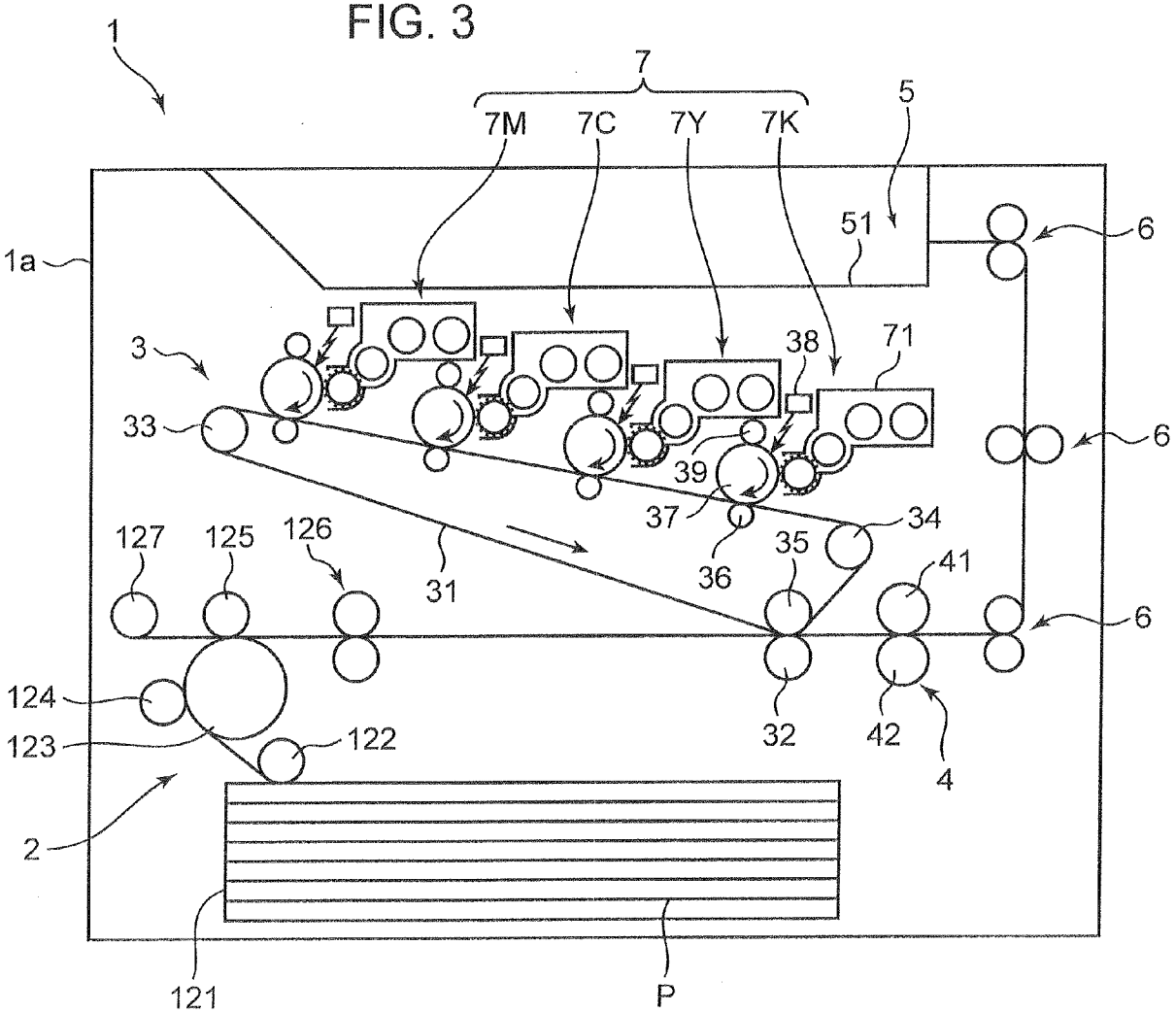
FIG. 3 is a schematic diagram illustrating the configuration of an image forming apparatus provided with an electrophotographic photoconductor according to an embodiment of the present disclosure.

FIG. 3 is a schematic diagram illustrating the configuration of an image forming apparatus provided with an electrophotographic photoconductor according to an embodiment of the present disclosure. A color printer 1 will be explained as an example of the image forming apparatus 1.

As illustrated in FIG. 3, the color printer 1 has a box-like main body 1*a*. In the main body 1*a* there are provided: a paper feed section 2 that feeds paper P; an image forming section 3 that transfers a toner image based on for instance, image data, onto paper P, having been fed by the paper feed section 2, as the paper P is transported; and a fixing section 4 for performing a fixing process of fixing, onto the paper P, an unfixed toner image that has been transferred onto the paper P in the image forming section 3. A paper output unit 5, onto which there is outputted the paper P that has been subjected to fixing in the fixing section 4, is provided at the top face of the main body 1*a*.

A paper feed cassette 121, a pickup roller 122, paper feed rollers 123, 124, 125 and resist rollers 126 are provided in the paper feed section 2. The paper feed cassette 121, which is provided so as to be insertable and removable to/from the main body 1*a*, stores paper P of various sizes. The pickup roller 122, which is provided at an upper left position of the paper feed cassette 121 in FIG. 3, picks up, sheet by sheet, the paper P that is stored in the paper feed cassette 121. The paper feed rollers 123, 124, 125 feed the paper P, having been picked up by the pickup roller 122, onto a paper transport pathway. The resist rollers 126 cause the paper P that has been fed out by the paper feed rollers 123, 124, 125 to wait for a time, and, thereafter, supply the paper to the image forming section 3 at a predetermined timing.

The paper feed section 2 is further provided with a pickup roller 127 and with a manual feed tray, not shown, that is attached to the left face, illustrated in FIG. 3, of the main body 1*a*. The pickup roller 127 picks up the paper P placed on the manual feed tray. The paper P picked up by the pickup roller 127 is fed onto the paper transport pathway by the paper feed rollers 123, 125, and is supplied to the image forming section 3 by the resist rollers 126 at a predetermined timing.

The image forming section 3 is provided with an image forming unit 7; an intermediate transfer belt 31 onto which there is primary-transferred, by the image forming unit 7, a toner image that is based on image data, electronically transmitted by a computer or the like, and that is formed on the surface (contact surface) of the image forming unit 7; and a secondary transfer roller 32 for performing secondary transfer, of the toner image on the intermediate transfer belt 31, onto the paper P that is fed in from the paper feed cassette 121.

The image forming unit 7 is provided with a unit 7K for black toner supply, a unit 7Y for yellow toner supply, a unit 7C for cyan toner supply and a unit 7M for magenta toner supply, that are sequentially disposed from the upstream side (right in FIG. 3) towards the downstream side. A respective photoconductor drum 37, as an image carrier, is disposed at the central position of each unit 7K, 7Y, 7C and 7M. The photoconductor drums 37 are disposed so as to be rotatable in the direction of the arrow (clockwise direction). Around each photoconductor drum 37 there are sequentially arranged, in order from the upstream side towards the downstream side of the rotation direction, for instance a charger 39, an exposure device 38, a developing device 71, a cleaning device, not shown, and a charge eliminator, not shown, as charge elimination means. The electrophotographic photoconductor is used as the photoconductor drum 37. The electrophotographic photoconductor according to the present embodiment can be used also in an image forming apparatus (printer) in which the charge eliminator as the charge elimination means is omitted.

The peripheral surface of the photoconductor drum 37, which is caused to rotate in the direction of the arrow, is charged uniformly by the charger (charging device) 39. Examples of the charger 39 include, for instance, corotron and scorotron chargers of contactless discharge type, as well as contact-type charging rollers, charging brushes and the like. The exposure device 38 is a so-called laser scanning unit that irradiates laser light based on image data that is inputted through a personal computer (PC), as a higher-order device, onto the peripheral surface of the photoconductor drum 37 having been charged uniformly by the charger 39, to form an electrostatic latent image, based on the image data, on the photoconductor drum 37. The developing device 71 supplies toner to the peripheral surface of the photoconductor drum 37, having an electrostatic latent image formed thereon, and a toner image based on the image data becomes formed as a result. The toner image is primary-transferred onto the intermediate transfer belt 31. Once primary transfer of the toner image onto the intermediate transfer belt 31 is over, the cleaning device cleans the toner that remains on the peripheral surface of the photoconductor drum 37. With primary transfer over, the charge eliminator eliminates the charge from the peripheral surface of the photoconductor drum 37. The peripheral surface of the photoconductor drum 37, having been subjected to a cleaning process by the cleaning device and the charge eliminator, is oriented towards the charger 39, to be subjected to a new charging process, and a new charging process is accordingly performed.

The intermediate transfer belt 31, which is an endless belt-like rotating body, is wrapped around a plurality of rollers, such as a driving roller 33, a driven roller 34, a backup roller 35 and a primary transfer roller 36, in such a manner that the surface (contact surface) side of the intermediate transfer belt 31, abuts the peripheral surface of each photoconductor drum 37. The intermediate transfer belt 31 is configured in such a manner so as to be caused to rotate endlessly, by the plurality of rollers, in a state where the intermediate transfer belt 31 is pressed against the photoconductor drums 37 by the primary transfer rollers 36 that are disposed opposing respective photoconductor drums 37. The driving roller 33, which is rotatably driven by a drive source such as a stepping motor, imparts driving force for causing the intermediate transfer belt 31 to rotate endlessly. The driven roller 34, the backup roller 35 and the primary transfer roller 36, which are rotatably provided, are driven to rotate as a result of the endless rotation of the intermediate transfer belt 31 elicited by the driving roller 33. The rollers 34, 35, 36 are driven to rotate, by way of the intermediate transfer belt 31, in accordance with the main-drive rotation of the driving roller 33, while supporting the intermediate transfer belt 31.

The primary transfer roller 36 applies primary transfer bias (of reverse polarity to that of the charging polarity of toner) to the intermediate transfer belt 31. As a result, the toner images formed on the photoconductor drums 37 are sequentially transferred (primary transfer) onto the intermediate transfer belt 31 that revolves in the direction of the arrow (counter-clockwise), through driving by the driving roller 33, between the photoconductor drums 37 and the primary transfer rollers 36.

The secondary transfer roller 32 applies secondary transfer bias of reverse polarity to that of the toner image, to the paper P. As a result, the toner image that has been primary-transferred onto the intermediate transfer belt 31 is transferred to the paper P between the secondary transfer roller 32 and the backup roller 35, and a color transfer image (unfixed toner image) is thereby transferred onto the paper P.

In the present embodiment, the transfer device is made up of the intermediate transfer belt 31, the primary transfer roller 36, the secondary transfer roller 32 and so forth.

The fixing section 4 performs a fixing process on the transfer image that is transferred to the paper P at the image forming section, and is provided with a heating roller 41, which is heated by an energized heating element, and a pressing roller 42 that is disposed opposite the heating roller 41, such that the peripheral surface of the pressing roller 42 is pressed against the peripheral surface of the heating roller 41.

The transfer image that is transferred onto the paper P by the secondary transfer roller 32 in the image forming section 3 is fixed to the paper P in a fixing process by heating as the paper P passes between the heating roller 41 and the pressing roller 42. The paper P having been subjected to the fixing process is outputted to the paper output unit 5. In the color printer 1 of the present embodiment, transport rollers 6 are disposed at respective sites between the fixing section 4 and the paper output unit 5.

The paper output unit 5 is formed as a recess sunken at the top of the main body 1*a* of the color printer 1, such that a paper output tray 51 that receives the outputted paper P is formed at the bottom of the sunken recess.

The image forming apparatus 1 forms an image on the paper P as a result of an image forming operation such as the one described above. A tandem-type image forming apparatus such as the one described above is provided with the electrophotographic photoconductor as the image carrier, and hence high-quality images can accordingly be formed.

EXAMPLES

The present disclosure will be explained in further detail next on the basis of examples. The present invention, however, is not limited in any way to the examples below.

[Synthesis of the Azoquinone Compound]

The azoquinone compound that is used in the various examples is synthesized first.

Synthesis Example 1

The azoquinone compound represented by formula (1-1) below was synthesized in accordance with synthesis method denoted by formula (2) and formula (3) above.

[Chem. 5]

(1-1)

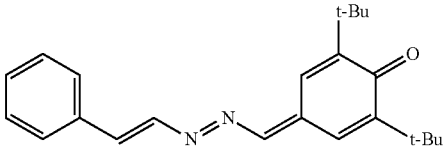

Firstly, specifically, 1.20 g (about 0.01 moles) of the compound represented by formula (A-1) below (molecular weight 120.1), and 2.5 g (about 0.05 moles) of hydrazine monohydrate (molecular weight 50.1), which is the compound represented by formula (B) above, were dissolved in 20 ml of methanol, in a flask, and the resulting solution was stirred for 1 hour at room temperature. The reaction of formula (2) above was set going as a result. Thereafter, water was added to the obtained reaction solution, followed by extraction with chloroform; the solvent in the obtained chloroform layer was distilled-off, to yield as a result a compound represented by formula (C-1) below (molecular weight 134.2).

[Chem. 6]

(A-1)

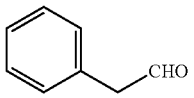

[Chem. 7]

(C-1)

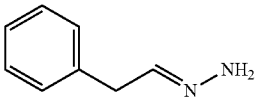

Figure 4:
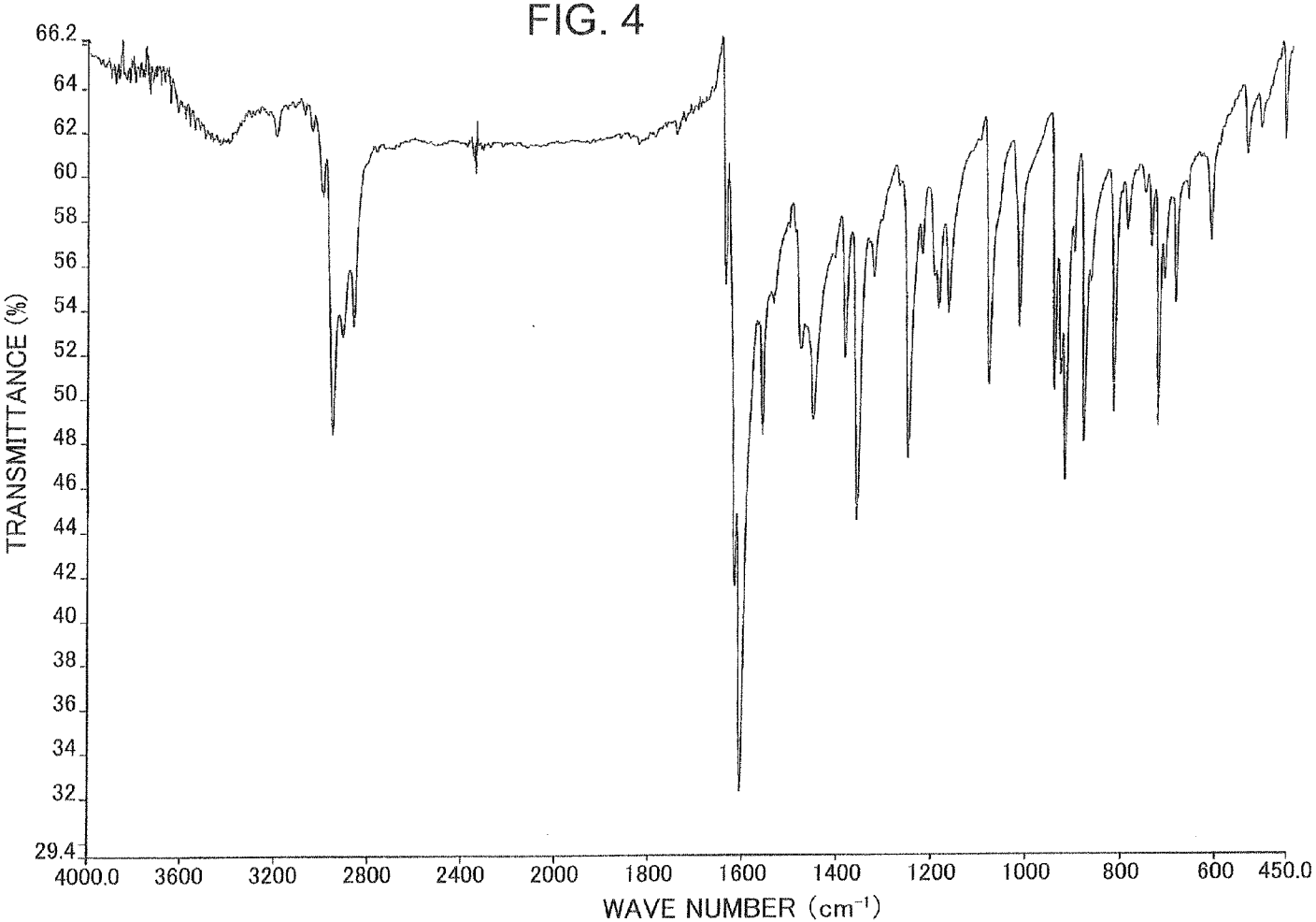
FIG. 4 is a graph illustrating an infrared absorption spectrum (IR spectrum) of a compound synthesized in Synthesis example 1.

Next, a solution resulting from dissolving the obtained compound represented by formula (C-1) above in 20 ml of methanol, plus 2.34 g (about 0.01 moles) of a compound represented by formula (D-1) below (molecular weight 234.3) were stirred for 1 hour at 50° C. Water was added to the reaction solution obtained through stirring, and the resulting reaction solution was extracted with chloroform. The solvent in the obtained chloroform layer was distilled-off. The obtained product was added to chloroform, and 3.2 g (about 0.015 moles) of silver oxide were added to the obtained chloroform solution of the product, followed by 30 minutes of stirring at room temperature. The reaction in formula (3) above was elicited as a result of the above operation. Thereafter, the obtained reaction solution was filtered, and the organic solvent in the obtained filtrate was distilled-off. The product was purified by column chromatography. As a result there were obtained 1.39 g of a solid product. The solid product was analyzed by IR spectroscopy. Herein a KBr tablet method was resorted to in IR spectroscopy. FIG. 4 illustrates the infrared absorption spectrum (IR spectrum) obtained by IR spectroscopy. The IR spectrum reveals for instance a peak (1606 $cm^{-1}$) derived from a carbonyl group. This showed that the obtained solid product was the azoquinone compound represented by formula (1-1) above. The yield of the azoquinone compound (molecular weight 348.5) represented by formula (1-1) above was 1.39 g (about 0.004 moles), and the yield rate about 40%.

[Chem. 8]

(D-1)

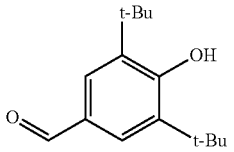

Synthesis Example 2

The azoquinone compound represented by formula (1-2) below was synthesized in the same way as in Synthesis example 1, but herein 1.34 g (about 0.01 moles) of the compound represented by formula (A-2) below (molecular weight 134.2) were used instead of 1.20 g (about 0.01 moles) of the compound represented by formula (A-1) above (molecular weight 120.1).

[Chem. 9]

(1-2)

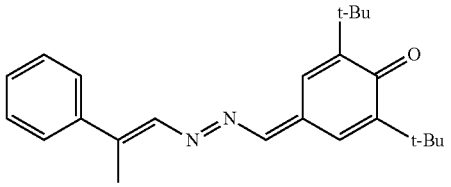

[Chem. 10]

(A-2)

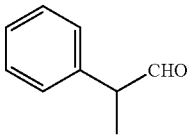

Figure 5:
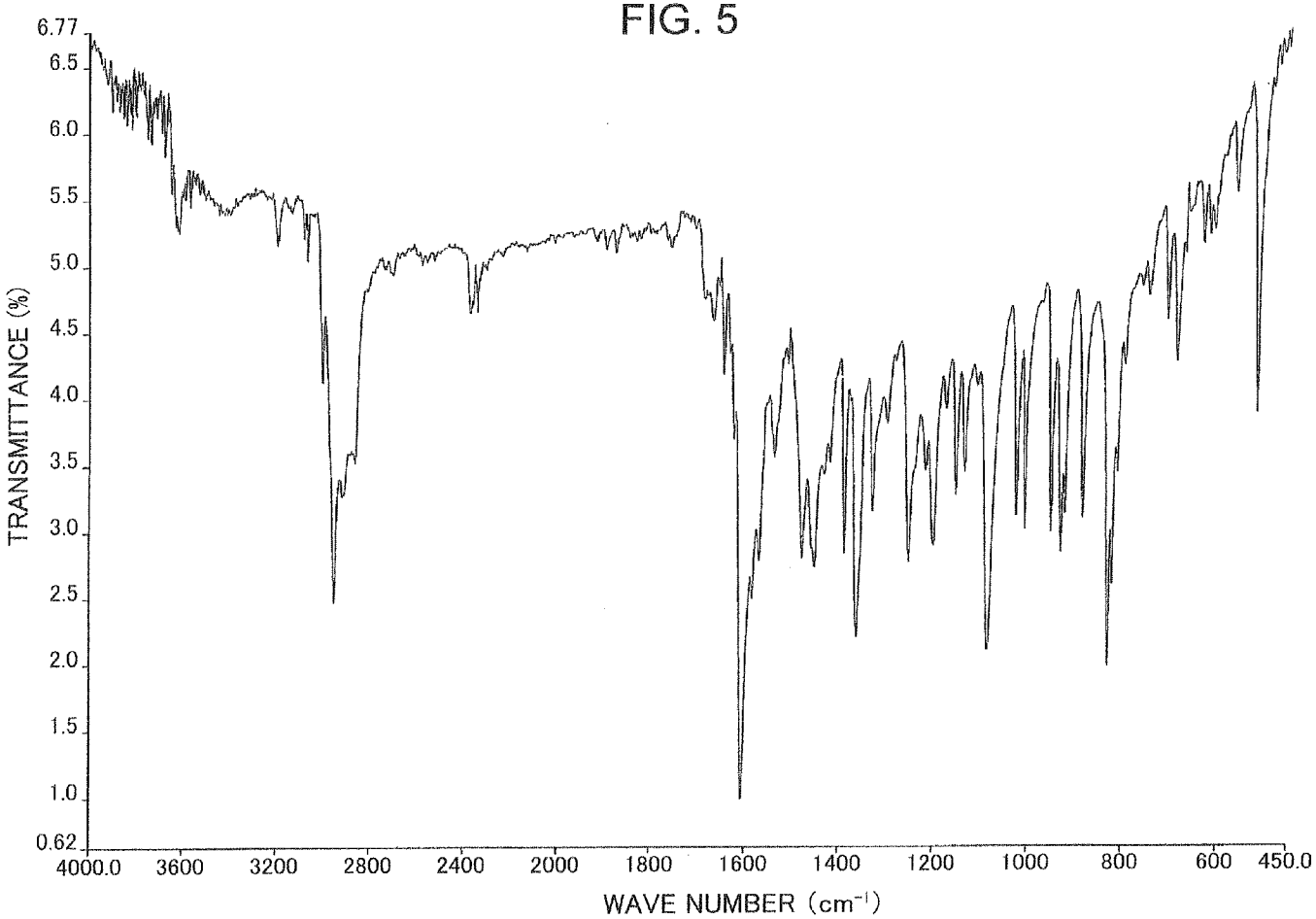
FIG. 5 is a graph illustrating an IR spectrum of a compound synthesized in Synthesis example 2.

As a result there were obtained 1.45 g of a solid product. The solid product was analyzed by IR spectroscopy. Herein a KBr tablet method was resorted to in IR spectroscopy. FIG. 5 illustrates the infrared absorption spectrum (IR spectrum) obtained by IR spectroscopy. The IR spectrum reveals for instance a peak (1607 $cm^{-1}$) derived from a carbonyl group. This showed that the obtained solid product was the azoquinone compound represented by formula (1-2) above. The yield of the azoquinone compound (molecular weight 362.5) represented by formula (1-2) above was 1.45 g (about 0.004 moles), and the yield rate about 40%.

Synthesis Example 3

The azoquinone compound represented by formula (1-3) below was synthesized in the same way as in Synthesis example 1, but herein 2.1 g (about 0.01 moles) of the compound represented by formula (A-3) below (molecular weight 210.3) were used instead of 1.20 g (about 0.01 moles) of the compound represented by formula (A-1) above (molecular weight 120.1).

[Chem. 11]

(1-3)

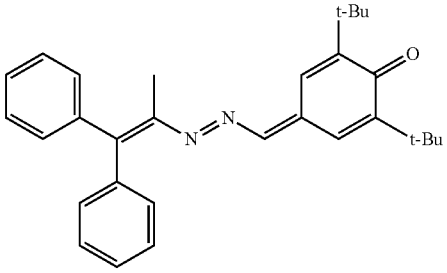

[Chem. 12]

(A-3)

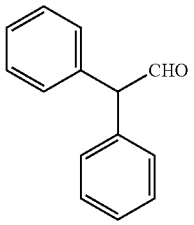

As a result there were obtained 1.53 g of a solid product. Results of IR spectroscopy showed that the obtained solid product was the azoquinone compound represented by formula (1-3) above. The yield of the azoquinone compound (molecular weight 438.6) represented by formula (1-3) above was 1.53 g (about 0.0035 moles), and the yield rate about 35%.

Synthesis Example 4

The azoquinone compound represented by formula (1-4) below was synthesized in the same way as in Synthesis example 1, but herein 1.5 g (about 0.01 moles) of the compound represented by formula (D-2) below (molecular weight 150.2) were used instead of 2.34 g (about 0.01 moles) of the compound represented by formula (D-1) above (molecular weight 234.3).

[Chem. 13]

(1-4)

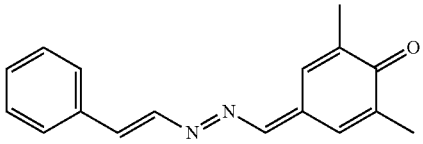

-continued

[Chem. 14]

(D-2)

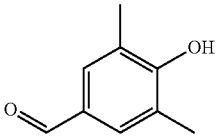

As a result there were obtained 1.06 g of a solid product. Results of IR spectroscopy showed that the obtained solid product was the azoquinone compound represented by formula (1-4) above. The yield of the azoquinone compound (molecular weight 264.3) represented by formula (1-4) above was 1.06 g (about 0.004 moles), and the yield rate about 40%.

Example 1

Herein, 5 parts by mass of X-form metal-free phthalocyanine (x-H2Pc) represented by formula (4) below, as a charge generating agent, 50 parts by mass of a benzidine derivative represented by formula (5) below, as a hole transport agent, 30 parts by mass of the azoquinone compound represented by formula (1-1) above, as an electron transport agent, and 100 parts by mass of a bisphenol Z-form polycarbonate resin (viscosity average molecular weight 50,000), as a binder resin, were charged into 800 parts by mass of tetrahydrofuran. The whole was mixed and dispersed for 50 hours in a ball mill. A coating solution for a photoconductive layer was obtained as a result.

[Chem. 15]

(4)

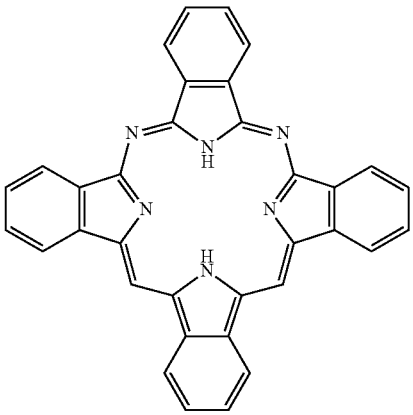

[Chem. 16]

(5)

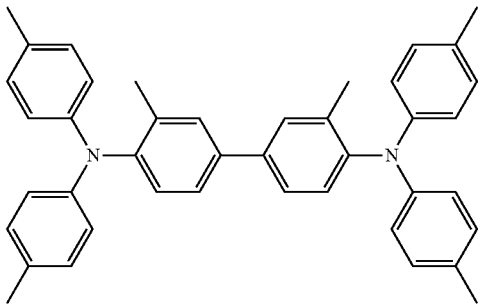

The obtained coating solution was applied, by dip coating, onto a conductive base that is formed of a base pipe of anodized aluminum, followed by hot-air drying at 100° C. for 40 minutes. As a result there was obtained a single layer-type photoconductor (diameter 30 mm) having a 30 μm-thick photoconductive layer formed on the conductive base.

Example 2

Example 2 was identical to Example 1, but herein the Y-form oxotitanylphthalocyanine (Y-TiOPc) represented by formula (6) below was used as the charge generating agent, instead of the X-form metal-free phthalocyanine (x-$H_2$Pc).

[Chem. 17]

(6)

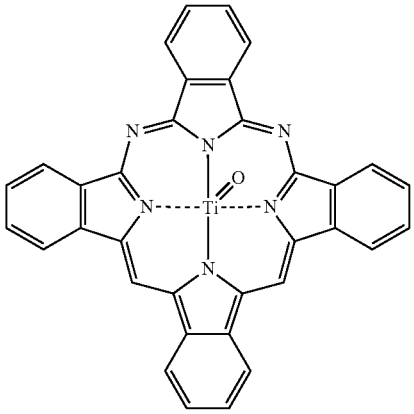

Example 3

Example 3 was identical to Example 1, but herein the azoquinone compound represented by formula (1-2) above was used, as the electron transport agent, instead of the azoquinone compound represented by formula (1-1) above.

Example 4

Example 4 was identical to Example 2, but herein the azoquinone compound represented by formula (1-2) above was used, as the electron transport agent, instead of the azoquinone compound represented by formula (1-1) above.

Example 5

Example 5 was identical to Example 1, but herein the azoquinone compound represented by formula (1-3) above was used, as the electron transport agent, instead of the azoquinone compound represented by formula (1-1) above.

Example 6

Example 6 was identical to Example 2, but herein the azoquinone compound represented by formula (1-3) above was used, as the electron transport agent, instead of the azoquinone compound represented by formula (1-1) above.

Example 7

Example 7 was identical to Example 1, but herein the azoquinone compound represented by formula (1-4) above was used, as the electron transport agent, instead of the azoquinone compound represented by formula (1-1) above.

Example 8

Example 8 was identical to Example 2, but herein the azoquinone compound represented by formula (1-4) above was used, as the electron transport agent, instead of the azoquinone compound represented by formula (1-1) above.

Comparative Example 1

Comparative example 1 was identical to Example 1, but herein the naphthoquinone derivative represented by formula (7) below was used as the electron transport agent, instead of the azoquinone compound represented by formula (1-1) above.

[Chem. 18]

(7)

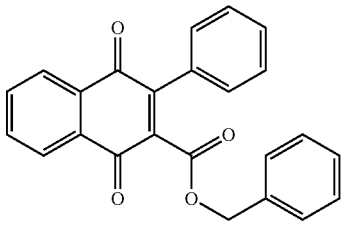

Comparative Example 2

Comparative example 2 was identical to Example 2, but herein the naphthoquinone derivative represented by formula (7) above was used, as the electron transport agent, instead of the azoquinone compound represented by formula (1-1) above.

[Evaluation]

The electrophotographic photoconductors of Examples 1 to 8 and Comparative examples 1 and 2 were evaluated in accordance with the method below.

(Photosensitivity Evaluation)

The photosensitivity of the various photoconductors was evaluated using a drum sensitivity tester by GENTEC.

Specifically, the peripheral surface of each photoconductor was charged through application of voltage, so that the peripheral surface potential of the photoconductor took on a value of 700 V. Thereafter, the charged photoconductor was exposed through irradiation of exposure light for 80 milliseconds. The exposure light that was used resulted from extracting, using a band-pass filter, monochromatic light having a wavelength of 780 nm, a half width of 20 nm, and an intensity of 16 μW/cm2, from white light irradiated by a halogen lamp. The surface potential of the photoconductor at the point in time where 330 milliseconds had elapsed since the start of exposure was measured as residual potential Vr (units: V). The smaller the potential Vr, the better is the photosensitivity denoted thereby.

The results are given in Table 1 together with the various materials of the photoconductive layers.

TABLE 1

| | Charge generation agent | Hole transport agent | Electron transport agent | Vr (V) |
|---|---|---|---|---|
| Example 1 | Formula (4) | Formula (5) | Formula (1-1) | 96 |
| Example 2 | Formula (6) | Formula (5) | Formula (1-1) | 89 |
| Example 3 | Formula (4) | Formula (5) | Formula (1-2) | 98 |
| Example 4 | Formula (6) | Formula (5) | Formula (1-2) | 91 |
| Example 5 | Formula (4) | Formula (5) | Formula (1-3) | 98 |
| Example 6 | Formula (6) | Formula (5) | Formula (1-3) | 92 |
| Example 7 | Formula (4) | Formula (5) | Formula (1-4) | 100 |
| Example 8 | Formula (6) | Formula (5) | Formula (1-4) | 94 |
| Comparative example 1 | Formula (4) | Formula (5) | Formula (7) | 146 |
| Comparative example 2 | Formula (6) | Formula (5) | Formula (7) | 127 |

As Table 1 shows, the electrophotographic photoconductors (Examples 1 to 8) that is provided with a conductive base and a photoconductive layer, and the photoconductive layer contained the azoquinone compound represented by formula (1) above, exhibited better photosensitivity than electrophotographic photoconductors (Comparative examples 1 and 2) that contained compounds other than the above azoquinone compound, as an electron transport agents.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An azoquinone compound represented by formula (1) below:

[Chem. 1]

(1)

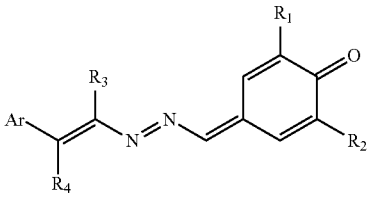

(in formula (1), $R_1$ to $R_4$ are identical or different and each represents a hydrogen atom, a C1 to C6 alkyl group or a C6 to C12 aryl group, and Ar represents a C6 to C12 aryl group).

2. An electrophotographic photoconductor, comprising:

a conductive base and a photoconductive layer, wherein the photoconductive layer contains the azoquinone compound according to claim 1.

3. The electrophotographic photoconductor according to claim 2, wherein the photoconductive layer is a layer containing, in one same layer, a charge generating agent, a hole transport agent, an electron transport agent and a binding resin, and the electron transport agent contains the azoquinone compound.

4. An image forming apparatus, comprising:

an image carrier;

a charging device for charging a surface of the image carrier;

an exposure device for exposing the surface of the charged image carrier, and forming thereby an electrostatic latent image on the surface of the image carrier;

a developing device for developing the electrostatic latent image in the form of a toner image; and a transfer device for transferring the toner image from the image carrier onto a transfer-receiving member, wherein the image carrier is the electrophotographic photoconductor according to claim 2.

* * * * *